US005512426A

United States Patent [19]

Levy

[11] Patent Number: 5,512,426

[45] Date of Patent: Apr. 30, 1996

[54] EMULSIONS WITH HIGH GRAIN SURFACE TO VOLUME RATIOS

[75] Inventor: David H. Levy, Rochester, N.Y.

[73] Assignee: Eastman Kodak Company, Rochester, N.Y.

[21] Appl. No.: 381,787

[22] Filed: Jan. 31, 1995

[51] Int. Cl.[6] ..... G03C 1/015; G03C 1/035

[52] U.S. Cl. ..... 430/567; 430/569; 430/570; 430/599

[58] Field of Search ..... 430/567, 570, 430/599, 569

[56] References Cited

U.S. PATENT DOCUMENTS

| | | | |
|---|---|---|---|
| 4,334,012 | 6/1982 | Mignot | 430/567 |
| 4,439,520 | 3/1984 | Kofron et al. | 430/434 |
| 4,471,050 | 9/1984 | Maskasky | 430/567 |
| 4,735,894 | 4/1988 | Ogawa | 430/567 |
| 5,264,337 | 11/1993 | Maskasky | 430/567 |
| 5,292,632 | 3/1994 | Maskasky | 430/567 |

FOREIGN PATENT DOCUMENTS

| | | | |
|---|---|---|---|
| 4139442 | 5/1992 | Japan | 430/567 |

OTHER PUBLICATIONS

*Research Disclosure*, vol. 365, Sep. 10, 1994, Item 36544, I.

*Primary Examiner*—Janet C. Baxter
*Attorney, Agent, or Firm*—Carl O. Thomas

[57] ABSTRACT

Radiation sensitive emulsions are disclosed in which surface sensitized silver halide grains are agglomerated into discrete clumps and the clumps are separated by peptizer. The emulsions exhibit a higher sensitivity than emulsions in which grains of the same mean size are individually separated by peptizer.

10 Claims, 2 Drawing Sheets

1 μm

10 μm

1 μm

EMULSIONS WITH HIGH GRAIN SURFACE TO VOLUME RATIOS

FIELD OF THE INVENTION

The invention relates to photographic emulsions.

BACKGROUND OF THE INVENTION

Conventional photographic silver halide emulsions contain discrete silver halide microcrystals (commonly referred to as grains) in a dispersing medium. The grains are typically formed by reacting silver and halide ions in an aqueous medium. A common reaction is as follows:

$$AgNo_3+Mx \rightarrow AgX+MnO_3$$

where

M is ammonium or an alkali metal and

X is a photographic halide (i.e., Cl, Br and/or I).

The reaction is referred to as a precipitation, since the silver halide is partitioned into a separate phase (the grains), but the grains remain dispersed in the aqueous medium. To avoid agglomeration of the grains, a peptizer (typically gelatin or a gelatin derivative) is incorporated in the dispersing medium. To eliminate the soluble by-products of precipitation (e.g., $MNO_3$ ), it is common practice to coagulate the gelatino-peptizer, thereby phase separating the gelatino-peptizer containing the grains dispersed therein from the remainder of the aqueous solution. Typically, the coagulated emulsion is washed to remove soluble salts, and the emulsion (the peptizer and the grains) is then again dispersed in water. The peptizer prevents the grains from agglomerating during coagulation and washing. After washing, the photographic emulsion is typically sensitized and prepared for coating as a layer in a photographic element by the incorporation of various addenda (e.g., stabilizers and antifoggants) along with binder, which also typically includes gelatin or a gelatin derivative. The peptizer and binder are commonly collectively referred to as photographic vehicle. The photographic vehicle forms a continuous phase of the photographic emulsion layer, and the grains are discretely dispersed in the vehicle.

Occasionally grains are formed or grown in the presence of antifoggants, stabilizers or spectral sensitizing dye, as illustrated by *Research Diclosure*, Vol. 365, September 1994, Item 36544, I. Emulsion grains and their precipitation, D. Grain modifying conditions and adjustments, paragraph (6). Research Disclosure is published by Kenneth Mason Publications, Ltd., Dudley House, 12 North St., Emsworth, Hampshire P010 7DQ, England.

Notice that in conventional emulsion preparations grain agglomeration or clumping is not allowed to occur. The terms "agglomeration" and "clumping" are here employed to indicate bringing separate grains into direct contact one with the other. That is, there is no peptizer separating the grains. The term "coagulation" herein and most commonly refers to precipitating the grains and peptizer together from an aqueous médium. While the term definitions herein adopted are consistent with the terminology of the art in most instances, the fact is that the art has employed a variety of terms, additionally including terms, such as flocculation, sedimentation, and coalescence, often with different meanings. Therefore, the teachings of the art must be considered carefully based on the substance of teachings rather than the choice of one adjective or another.

Mignot U.S. Pat. No. 4,334,012 illustrates an approach to growing silver halide grains to larger sizes in the absence of peptizer while avoiding agglomeration of the grains.

It has been speculated that discrete grains may occasionally be produced by the coalescence of two or more discrete grains. As the term "coalescence" is here employed, the difference between grains formed by coalescence and agglomerated grains is that grains formed by coalescence appear to be unitary, discrete grains, whereas agglomerated grains are aggregations of grains. For example, in Maskasky U.S. Pat. Nos. 5,264,337 and 5,292,632, which disclose unitary tabular grains, one speculation is that the tabular grains may be the result of coalescence of grain nuclei during precipitation.

When a silver halide emulsion is imagewise exposed, the exposed grains are rendered developable or, in direct-positive emulsions, nondevelopable. Larger grains have larger projected areas and hence a better opportunity to capture photons during imagewise exposure than finer grains. Also, larger grains make larger contributions to image formation than finer grains. Larger grain sizes are recognized to impart higher levels of photographic sensitivity.

Beginning in the early 1980's and continuing to the present, there has been considerable interest in tabular grain emulsions. Kofron et al U.S. Pat. No. No. 4,439,520 is representative. Among the post-discovery rationalizations of tabular grain emulsion performance advantages has been the observation that tabular grains exhibit a high ratio of grain surface area to volume. The surface to volume ratio is increased as the aspect ratio, the ratio of equivalent circular diameter (ECD) to grain thickness, increases. Thus, tabular grains can range up to very large sizes, with mean ECD's of up to 10 μm being accepted as the practical upper limit of photographic utility.

It is, of course, not just the high surface to volume ratio of tabular grains that render them attractive. Surface to volume ratios equal to and higher than those of tabular grains are readily provided by fine grain emulsions. Unfortunately, the limited photographic speeds of fine grain emulsions have precluded their substitution for larger grain emulsions.

SUMMARY OF THE INVENTION

It is an object of the invention to provide emulsions that combine the known advantages of high surface to volume ratio grains, including surface to volume ratios exceeding those of tabular grain emulsions, with speeds well in excess of those that have been achieved with conventional fine grain emulsions.

In one aspect, this invention is directed to a radiation sensitive emulsion comprised of a dispersing medium containing a peptizer and silver halide grains wherein the silver halide grains (1) are each surface sensitized and (2) are agglomerated into discrete clumps, the discrete clumps being separated by the peptizer.

It has been discovered quite unexpectedly that emulsions prepared with grains agglomerated into discrete clumps exhibit much higher photographic speeds than when the same grains are individually separated by peptizer. Thus, each grain clump is taking on the sensitivity of a grain larger in size than any of the individual grains in the clump. While the grain clumps are exhibiting the sensitivity of larger mean grain sizes, it is important to observe that the surface areas of the grains in the clumps and particularly their surface to volume ratios remain well above that which can be realized by replacing the clumps with separate grains of the same silver content.

BRIEF DESCRIPTION OF THE DRAWINGS

The figures are scanning electron micrographs.

DESCRIPTION OF PREFERRED EMBODIMENTS

Figure 1:
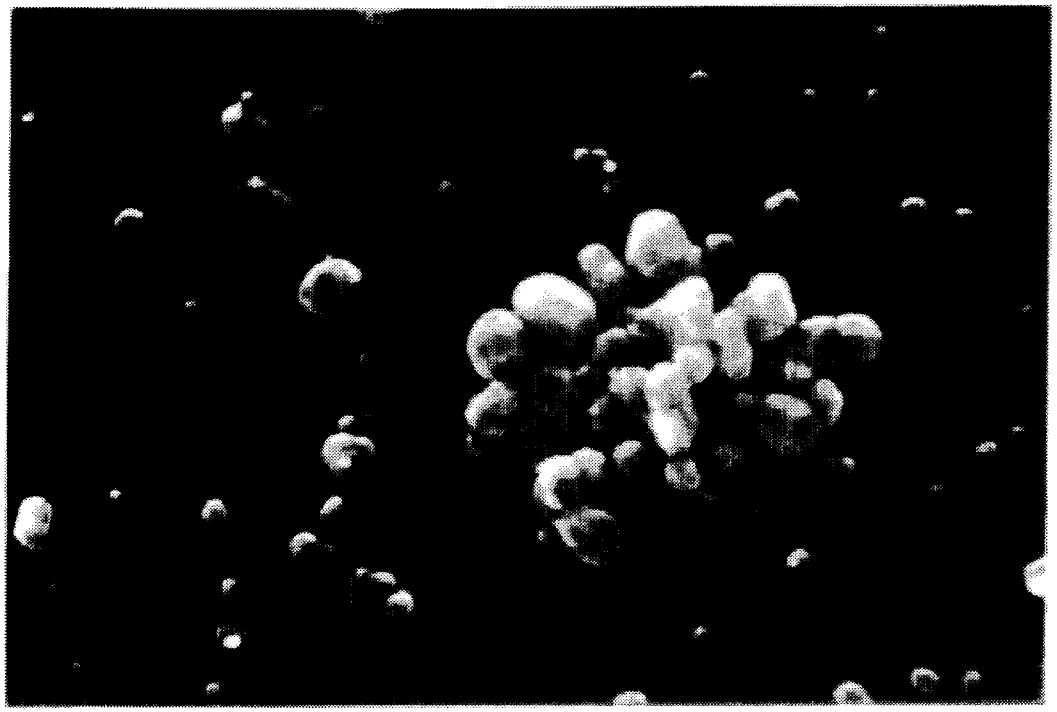
FIG. 1 is view of an individual clump of agglomerated grains.

The silver halide grains present in the emulsions of the invention can be of any conventional composition. The silver halide grains can be silver chloride, silver bromide or silver iodide grains. The grains can be of mixed halide content, such as silver iodochloride, silver bromochloride, silver chlorobromide, silver bromide, silver iodobromide, silver chloroiodobromide or silver iodochlorobromide grains, where the halides are named in order of ascending concentrations.

The grains can be formed by any convenient conventional technique for preparing grains in the absence of a peptizer. It is generally recognized that grain nucleation can be accomplished in the absence of a peptizer without grain agglomeration occurring. Thus, a wide range of conventional grain nucleation techniques are available. Those that employ a peptizer during grain nucleation can be readily modified for use in the practice of the invention merely by omitting the peptizer.

As grain growth continues the risk of grain agglomeration increases. For continued growth of the grains in the absence of peptizer, conventional techniques for accomplishing this can be followed. For example, French Patent 1,173,517 describes a process for preparing silver halide dispersions in the absence of peptizer. To prevent silver halide grain agglomeration, it is taught (a) to use highly dilute aqueous salt solutions——e.g, to run in dilute silver and halide salt solutions or (b) to prepare highly ammoniacal silver halide dispersions using more concentrated salt solutions. Mignot U.S. Pat. No. 4,334,012, here incorporated by reference, discloses that employing ultrafiltration during grain growth allows relatively large grain sizes to be achieved in the absence of peptizer without resorting to ammoniacal or dilute solutions and without grain agglomeration.

Dopants can be incorporated in the grains, if desired, during nucleation and/or growth. Grain dopants, their levels, and techniques for their incorporation are disclosed in Research Disclosure, Item 36544, cited above and here incorporated by reference, I. Emulsion grains and their preparation, D. Grain modifying conditions and adjustments, paragraph (3).

The grains as originally formed can be of any size that can be obtained by conventional precipitation techniques not employing a peptizer. Mean grain volumes of up to $1.5\times10^{-2}$ $\mu m^3$ are specifically contemplated. This is just slightly larger than the mean grain volume of spherical grains having a mean ECD of 0.3 μm. The grains preferably have a mean volume of up to $1\times10^{-2}$ $\mu m^3$. Since the grains are agglomerated to increase their observed speed, the mean ECD of the grains can be smaller than those of emulsions of comparable speed with discrete, separately peptized grains. For example, minimum mean grain sizes can range down to those of Lippmann emulsions. For example, minimum grain sizes of down to 0.01 μm or less are contemplated, but typically the individual grains exhibit a mean ECD of at least 0.05 μm.

Since all small grains have relatively high surface to volume ratios, the grains can take any convenient conventional shape. The grains can be regular or irregular. In smaller grain sizes the ripening that is typical at the corners and edges grains tends to minimize the performance differences that can be attributed to alternate choices of grain shapes. For example, in smaller grain sizes cubes and octahedra with edge and corner ripening usually approximate the performance of spherical grains.

Once the grains have been grown to their selected size as discrete entities in an aqueous dispersing medium that contains no peptizer (e.g., no gelatin or similar hydrophilic colloid), the grains are next brought into contact with sensitizers. Chemical and/or spectral sensitizers are brought into contact with the grain surfaces before grain agglomeration is undertaken. The advantage of bringing the grains into contact with the sensitizers before grain agglomeration is that the full surface area of the grains is available to accept sensitizer.

The grain surfaces can be brought into contact with any conventional choice of chemical sensitizers, such as sulfur, gold and/or reduction sensitizers. Conventional chemical sensitizers and techniques for their use are disclosed in Research Disclosure, Item 36544, cited above, IV. Chemical sensitization. Conventionally, chemical sensitization takes place in two steps. First the chemical sensitizer is brought into contact with the grains. Then the grains are heated (finished) with the chemical sensitizer present. In the practice of the invention it is possible to perform both steps before grain agglomeration takes place. However, it is preferred to bring the chemical sensitizers into contact with the grain surfaces before grain agglomeration is undertaken and to defer the finishing step, which completes chemical sensitization until after grain agglomeration. Deferring finishing until after grain agglomeration offers the advantage of shortening the duration within which the grains must be held in a discrete dispersed form before peptizer is introduced. This reduces the risk of an unintended or uncontrolled agglomeration of the grains.

Several alternative sequences are possible:

Sequence CS-1

The dispersed grains in the absence of peptizer are brought into contact with a chemical sensitizer and immediately finished before subsequent process steps are undertaken. In this approach chemical sensitization, including the levels of sensitizers are no different than in conventional practice.

Sequence CS-2

The dispersed grains in the absence of peptizer are brought into contact with a chemical sensitizer. Before finishing the grains are agglomerated and peptizer is added as described below. Finishing is next conducted without any intervening washing step. Although emulsions are most commonly prepared by washing before proceeding to chemical sensitization, the present process particularly lends itself to omitting the washing step, since the conventional techniques for holding discrete grains in dispersion in the absence of peptizer include maintaining low levels of soluble salts (refer to Mignot U.S. Pat. No. 4,334,012 and French Patent 1,173,517, cited above). Notice that the Mignot process of performing ultrafiltration during emulsion preparation effectively achieves washing without the conventional emulsion coagulation step.

Sequence CS-3

The dispersed grains in the absence of peptizer are brought into contact with a chemical sensitizer. Before finishing the grains are agglomerated and peptizer is added as described below. A conventional washing step is next performed. Conventional washing procedures are summarized in Research Disclosure, Vol. 308, December 1989, Item 308119, II. Emulsion washing. Finishing is conducted after the washing step. Since there is an opportunity for chemical sensitizers to be removed during the washing step before finishing, somewhat higher concentrations of chemical sensitizers may be required than in Sequences CS-1 and CS-2. In addition to or as an alternative to increasing the level of chemical sensitizer to offset chemical sensitizer loss in washing, it is contemplated that chemical sensitizer can be added a second time after washing and before finishing.

It is not required that the emulsions of the invention be spectrally sensitized, since native sensitivity to the ultraviolet and/or visible spectrum can be relied upon. However, it is preferred to add to the discrete grains before agglomeration one or a combination of spectral sensitizing dyes. The spectral sensitizing dyes can be added to the grains with the chemical sensitizers (in sequence or concurrently) as described above or in place of the chemical sensitizers.

Several sequences are possible:

Sequence DS-1

Spectral sensitizing dye is added to the dispersed grains before agglomeration just before, at the same time or just after chemical sensitizers are added. The remainder of the sequence can take any of the forms of Sequences CS-1, CS-2 or CS-3. This sequence is specifically preferred, since it provides both the chemical and spectral sensitizers maximum access to the grain surfaces.

Sequence DS-2

Spectral sensitizing dye is added to the dispersed grains before grain agglomeration. Chemical sensitizer addition is deferred until later in the preparation process——e.g., after agglomerated grains have been formed. Chemical sensitization after spectral sensitizing dye has been adsorbed to the grain surfaces is well known to be feasible. Attention is directed to Research Disclosure, Item 36544, I. Emulsion grains and their precipitation, D. Grain modifying conditions and adjustments, paragraph (6), cited above. Also, Kofron et al U.S. Pat. No. 4,439,520, cited above and here incorporated by reference, specifically discloses "dye in the finish" sensitizations to be preferred. Although the chemical sensitizers do not have maximum access to the grain surfaces, the grain surfaces in each grain clump remaining accessible after grain agglomeration still compares favorably with unitary grains of the same mass as the clumps.

Sequence DS-3

Any one of Sequences CS-1, CS-2 and CS-3 are employed with spectral sensitizing dye being added after grain agglomeration has occurred. Again, the spectral sensitizing dye does not have access to the full surface area of each grain, but the grain clumps still afford large available surfaces for dye adsorption. In this sequence spectral sensitization is closely analogous, if not identical to conventional spectral sensitizations.

Of all the possible sequences set forth above, including CS-1, CS-2 and CS-3 as well as DS-1, DS-2 and DS-3, DS-1 and DS-2 are most specifically preferred, since adsorption of dye to the grain surfaces approximates monomolecular layer coverages, typically from 30 to 100 percent of monomolecular coverage. This protects the grains from the possibility of coalescence after agglomeration.

Any conventional spectral sensitizing dye can be employed. Conventional spectral sensitizing dyes and their use are described in Research Disclosure, Item 36544, cited above, V. Spectral sensitization and desensitization. Spectral sensitization, unlike chemical sensitization, does not require a separate finishing step. The spectral sensitizing dye immediately adsorbs to the available grain surfaces upon addition to the dispersing medium.

Once the selected sensitizer or combination of sensitizers have been brought into contact with the grain surfaces, a controlled agglomeration of the grains is undertaken in the absence of peptizer to produce grain clumps. To achieve grain clumping, procedures can be employed opposite to those known to be useful for maintaining grains suspended as discrete particles in the absence of peptizer. For example, instead of maintaining low concentrations of dissolved salts to avoid grain agglomeration as taught by French Patent 1,173,517 and Mignot U.S. Pat. No. 4,334,012, grain agglomeration can be initiated by adding soluble salts. For example, the addition of $MNO_3$, a by-product of silver halide precipitation, can be employed to initiate grain agglomeration. Grain agglomeration occurs in response to increasing the concentration of dissolved ions in the aqueous medium in which the discrete grains are suspended. While almost any ionizable compound can be added to the aqueous medium, $MNO_3$ is particularly convenient, since it is a common by-product of silver halide precipitation. Thus, the photographic consequences of the presence of $MNO_3$ are both minimal and well understood.

As grain agglomeration proceeds, groups of grains clump together. The grain clumps are limited to sizes comparable to grain sizes in conventional emulsions in which the grains are individually dispersed. For example, it is generally accepted that the largest useful mean ECD emulsion grain size is about 10 μm. Thus, in the practice of the invention the grain clumps are limited in size so that their projected areas have mean ECD's of up to 10 μm. The actual selection of a mean clump size is, as in conventional photography, dependent upon the desired balance between speed (sensitivity) and image noise (granularity) desired. For most photographic applications clumps with mean ECD's of from 0.2 to 5 μm are contemplated.

For a grain clump to exist at least two grains must be present. However, it is preferred that there be on average at least 5 grains per clump. By maintaining the mean ECD of the grains low in comparison to the mean ECD of the clumps, the size disparity of the clumps can be reduced and the relative speed advantage of the emulsion compared to an emulsion with discrete grains of the same mean size is increased.

To arrest grain agglomeration so that grain clumps are obtained with a mean grain size in a desired range, a small amount of peptizer is added to the aqueous medium in which the clumps are being formed. Any level of peptizer known to be useful in conventional emulsion precipitations in which the grains are maintained separately suspended can be employed. Typically peptizer concentrations in conventional emulsion precipitation are maintained in the range of from 0.2 to 10 percent by weight, based on the total weight of the contents within the reaction vessel.

Although only low levels of peptizer are required to arrest grain agglomeration, it is recognized that higher levels of peptizer can be added, if desired. Typically the emulsion containing grain clumps as initially formed also contains from about 5 to 50 grams of peptizer per mole of silver halide, preferably from 10 to 30 grams of peptizer per mole of silver halide. Additional vehicle can be added to bring the concentration up to as high as 1000 grams per mole of silver halide. Preferably the concentration of vehicle in the finished emulsion is above 50 grams per mole of silver halide. When coated and dried in forming a photographic element the vehicle preferably forms about 30 to 70 percent by weight of the emulsion layer.

Vehicles (which include both binders and peptizers) can be chosen from among those conventionally employed in silver halide emulsions. Preferred peptizers are hydrophilic colloids. Suitable hydrophilic materials include both naturally occurring substances such as proteins, protein derivatives, cellulose derivatives——e.g., cellulose esters, gelatin—— e.g., alkali-treated gelatin (cattle bone or hide gelatin) or acid-treated gelatin (pigskin gelatin), gelatin derivatives——e.g., acetylated gelatin, phthalated gelatin and the like, polysaccharides such as dextran, gum arabic, zein, casein, pectin, collagen derivatives, collodion, agar-agar, arrowroot, albumin and the like as described in Yutzy et al U.S. Pat. Nos. 2,614,928 and '929, Lowe et al U.S. Pat. Nos. 2,691,582, 2,614,930, '931, 2,327,808 and 2,448,534, Gates et al U.S. Pat. Nos. 2,787,545 and 2,956,880, Himmelmann et al U.S. Pat. No. 3,061,436, Farrell et al U.S. Pat. No. 2,816,027, Ryan U.S. Pat. Nos. 3,132,945, 3,138,461 and 3,186,846, Dersch et al U.K. Patent 1,167,159 and U.S. Pat. Nos. 2,960,405 and 3,436,220, Geary U.S. Pat. No. 3,486,896, Gazzard U.K. Patent 793,549, Gates et al U.S. Pat. Nos. 2,992,213, 3,157,506, 3,184,312 and 3,539,353, Miller et al U.S. Pat. No. 3,227,571, Boyer et al U.S. Pat. No. 3,532,502, Malan U.S. Pat. No. 3,551,151, Lohmer et al U.S. Pat. No. 4,018,609, Luciani et al U.K. Patent 1,186,790, U.K. Patent 1,489,080 and Hori et al Belgian Patent 856,631, U.K. Patent 1,490,644, U.K. Patent 1,483,551, Arase et al U.K. Patent 1,459,906, Salo U.S. Pat. Nos. 2,110,491 and 2,311,086, Fallesen U.S. Pat. No. 2,343,650, Yutzy U.S. Pat. No. 2,322,085, Lowe U.S. Pat. No. 2,563,791, Talbot et al U.S. Pat. No. 2,725,293, Hilborn U.S. Pat. No. 2,748,022, DePauw et al U.S. Pat. No. 2,956,883, Ritchie U.K. Patent 2,095, DeStubner U.S. Pat. No. 1,752,069, Sheppard et al U.S. Pat. No. 2,127,573, Lierg U.S. Pat. No. 2,256,720, Gaspar U.S. Pat. No. 2,361,936, Farmer U.K. Patent 15,727, Stevens U.K. Patent 1,062,116, Yamamoto et al U.S. Pat. No. 3,923,517 and Maskasky U.S. Pat. No. 5,284,744. Relatively recent teachings of gelatin and hydrophilic colloid peptizer modifications and selections are illustrated byMoll et al U.S. Pat. Nos. 4,990,440 and 4,992,362 and EPO 0 285 994, Koepff et al U.S. Pat. No. 4,992,100, Tanji et al U.S. Pat. No. 5,024,932, Schulz U.S. Pat. No. 5,045,445, Dumas et al U.S. Pat. No. 5,087,694, Nasrallah et al U.S. Pat. No. 5,210,182, Specht et al U.S. Pat. No. 5,219,992, Nishibori U.S. Pat. Nos. 5,225,536, 5,244,784, Tavernier EPO 0 532 094, Kadowaki et al EPO 0 551 994, Sommerfeld et al East German DD 285 255, Kuhrt et al East German DD 299 608, Wetzel et al East German DD 289 770 and Farkas U.K. Patent 2,231,968.

Where the peptizer is gelatin or a gelatin derivative it can be treated prior to or following introduction into the. emulsion with a methionine oxidizing agent. Examples of methionine oxidizing agents include NaOCl, chloramine, potassium monopersulfate, hydrogen peroxide and peroxide releasing compounds, ozone, thiosulfates and alkylating agents. Specific illustrations are provided by Maskasky U.S. Pat. Nos. 4,713,320 and 4,713,323, King et al U.S. Pat. No. 4,942,120, Takada et al EPO 0 434 012 and Okumura et al EPO 0 553 622.

While the hydrophilic colloids have utility both as peptizers and binders and thus can alone form the photographic vehicle of a completed photographic element, it is conventional practice to add other binders in forming the emulsion and other layers of photographic elements. Further, the vehicle when coated is hardened. The use of vehicles, including peptizers, hardeners and non-peptizer binders following the step of arresting grain agglomeration can take any convenient conventional form. Conventional materials and techniques are disclosed in Research Disclosure, Item 36544, cited above, II. Vehicles, vehicle extenders, vehicle-like addenda and vehicle related addenda.

Instead of or in addition to adding a soluble compound to the aqueous medium whose sole function is to initiate grain agglomeration, it is specifically contemplated to employ an ionic sensitizer that initiates grain agglomeration in the absence of peptizer concurrently with interacting with the surfaces of the grains. For example, an ionizable gold salt of the type employed for chemical sensitization can be added alone or in combination with $MNO_3$ to initiate grain agglomeration. Specific examples of ionizable gold salts are contained in Research Disclosure, Item 36544, cited above IV. Chemical sensitizers, paragraph (2). Deaton U.S. Pat. Nos. 5,049,484 and 5,049,485, the disclosures of which is here incorporated by reference, represent specifically preferred ionizable gold salts.

As another example, spectral sensitizing dyes in one or more resonance forms typically take anionic, cationic or zwitterionic forms, which renders them useful in initiating grain agglomeration. Among ionic spectral sensitizing dyes that can be employed to facilitate grain agglomeration are polymethine dyes, such as cyanines, merocyanines, complex cyanines and merocyanines (i.e., tri-, tetra- and poly-nuclear cyanines and merocyanines), oxonols, hemioxonols, styryls, merostyryls, streptocyanines, hemicyanines and arylidenes.

For example, in one preferred form the cyanine spectral sensitizing dyes satisfy the formula:

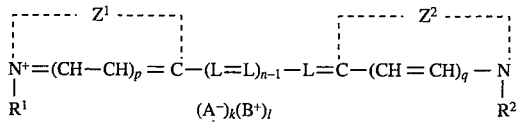

(I)

wherein:

$Z^1$ and $Z^2$ each independently represent the atoms necessary to complete a 5- or 6-membered azole or azine heterocyclic nucleus, such as oxazoline, oxazole, benzoxazole, the napthoxazoles (e.g., naphth[2,1-d]-oxazole, naphth[2,3-d]oxazole and naphth[1,2-d]oxazole), thiazoline, thiazole, benzothiazole, the napththothiazoles (e.g., naptho[2,1-d]thiazole), the thiazoloquinolines (e.g., thiazolo[4,5-b]quinoline), selenazoline, selenazole, benzoselenazole, the napthoselenazoles (e.g., naphtho[1,2-d]selenazole, 3H-indole (e.g., 3,3-dimethyl-3H-indole), the benzindoles (e.g., 1,1-dimethylbenz[ e]indole), imidazoline, imidazole, benzimidazole, the naphthimidazoles (e.g., napth[2,3-d]-imidazole), pyridine and quinoline, which nuclei may be substituted on the ring by one or more of a wide variety of substituents, such as hydroxy, halogen (e.g., fluoro, chloro, bromo or iodo), alkyl groups or substituted alkyl groups (e.g., methyl, ethyl, propyl, isopropyl, butyl, octyl, dodecyl, octadecyl, 2-hydroxyethyl, 3-sulfopropyl, carboxymethyl, 2-cyanoethyl and trifluoromethyl), aryl groups and substituted aryl groups (e.g., phenyl, 1-naphthyl, 2-naphthyl), 4-sulfophenyl, 3-carboxyphenyl and 4-biphenyl), araalkyl groups (e.g., benzyl and phenethyl), alkoxy groups (e.g., methoxy, ethoxy and isopropoxy), aryloxy groups (e.g., phenoxy and 1-naphthoxy), alkylthio groups (e.g., methylthio and ethylthio), arylthio groups (e.g., phenylthio, p-tolylthio and 2-naphthylthio), methylenedioxy, cyano, 2-thienyl, styryl, primary or secondary amino groups (e.g., amino, methyl amino, dimethylamino, diethylamino, morpholino and anilino), acyl groups, such as carboxy (e.g., acetyl and benzoyl) and sulfo;

$R^1$ and $R^2$ can be the same or different quaternizing groups, such as alkyl groups, aryl groups, alkenyl groups or aralkyl groups, with or without substituents (e.g., with substituents such as carboxy, hydroxy, alkoxy, sulfo, sulfato, thiosulfato, phosphono and halo substituents);

L in each occurrence is independently selected from methine groups and methine groups substituted with alkyl of from 1 to 4 carbon atoms;

n is a positive integer from 1 to 4;

p and q each independently represents 0 or 1;

A is an anionic group;

B is a cationic group; and k and 1 may be 0 or 1, as required to provide overall charge neutrality for the dye molecule.

Variants are, of course, possible in which an alkylene bridge is formed by two of the $R^1$, $R^2$ and L groups. To extend peak absorption into the infrared portion of the spectrum n can be increased up to 12 or more.

As another example, preferred merocyanine spectral sensitizing dyes satisfy the formula:

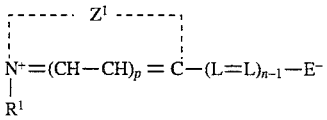

(II)

wherein $Z^1$, $R^1$, L, p and n can take any of the forms described above in connection with cyanine dyes and E represents the atoms necessary to complete an acidic nucleus.

In a preferred form E can be represented by the formula:

(III)

wherein

D is a cyano, sulfo, or carbonyl group;

D' is a methine substituent, such as alkyl of from 1 to 4 carbon atoms, or

D and D' together complete a five or six membered carbocyclic or heterocyclic ring containing ring atoms chosen from the class consisting of carbon, nitrogen, oxygen and sulfur.

When E is an acylic group (that is, D and D' are independent groups), E can be chosen from among groups such as malononitrile, alkylsulfonylacetonitrile, cyanomethyl benzofuranyl ketone or cyanomethyl phenyl ketone. In preferred cyclic forms of E, D and D' together complete a 2-pyrazolin-5-one, pyrazolidene 3,5-dione, imidazoline-5-one, hydantoin, 2 or 4-thiohydantoin, 2-iminooxazoline-4-one, 2-oxazoline-5-one, 2-thiooxazolidine-2,4-dione, isoxazoline-5-one, 2-thiazoline-4-one, thiazolidine-4-one, thiazoline-2,4-dione, rhodanine, thiazolidine-2,4-dithione, isorhodanine, indane-1,3-dione, thiophene-3-one, thiophene-3-1,1-dioxide, indoline-2-one, indoline-3-one, indazoline-3one, 2-oxoindazolinium, 3-oxoindazolinium, 5,7-dioxo- 6,7-dihydrothiazolo[3,2-a]pyrimidine, cyclohexane-1,3-dione, 3,4-dihydroisoquinoline-4-one, 1,3-dioxane-4,6-dione, barbituric acid, 2-thiobarbituric acid, chroman-2,4-dione, indazoline-2-one or pyrido[1,2-a]pyrimidine-1,3-dione nucleus. Conventional ring substituents are contemplated, including, for example, any those ring substituents recited above in the definition of $Z^1$ and $Z^2$.

In formulae I, II and III above, all alkyl and alkenyl groups or moieties referred to can contain any convenient number of carbon atoms, except as otherwise stated. Typically the alkyl groups and moieties each contain up to 20 carbon atoms, preferably from 1 to 8 carbon atoms and the alkenyl groups contain from 2 to 8 carbon atoms. Similarly, all aryl groups or moieties referred to can contain any convenient number of carbon atoms, except as otherwise stated. Typically the aryl groups or moieties contain from 6 to 14 carbon atoms. Preferred aryl groups or moieties are phenyl and naphthyl.

The following are specific illustrations of spectral sensitizing dyes contemplated for use in the practice of the invention:

SS-1

Anhydro-5'-chloro-3,3'-bis(3-sulfopropyl)naphtho[ 1,2-d] thiazolothiacyanine hydroxide, triethylammonium salt

SS-2

Anhydro-5'-chloro-3,3'-bis(3-sulfopropyl)naphtho[ 1,2-d] oxazolothiacyanine hydroxide, sodium salt

SS-3

Anhydro-4,5-benzo-3'-methyl-4'-phenyl-1-(3-sulfopropyl-)naphtho[ 1,2-d]thiazolothiazolocyanine hydroxide

SS-4

1,1'-Diethylnaphtho[1,2-d]thiazolo-2'-cyanine bromide

SS-5

Anhydro-1,1'-dimethyl-5,5'-bis(trifluoromethyl)- 3-(4-sulfobutyl)-3'-(2,2,2-trifluoroethyl)benzimidazolocarbocyanine hydroxide

SS-6

Anhydro-3,3'-bis(2-methoxyethyl)-5,5'-diphenyl-9-ethyloxacarbocyanine, sodium salt

SS-7

Anhydro-1,1'-bis(3-sulfopropyl)-11-ethylnaphtho[1,2-d]-oxazolocarbocyanine hydroxide, sodium salt

SS-8

Anhydro-5,5'-dichloro-9-ethyl-3,3'-bis(3-sulfopropyl)-oxaselenacarbocyanine hydroxide, sodium salt

SS-9

5,6-Dichloro-3',3'-dimethyl- 1,1',3-triethylbenzimidazolo-3H-indolocarbocyanine bromide

SS-10

Anhydro-5,6-dichloro-1,1-diethyl-3-(3-sulfopropylbenzimidazolooxacarbocyanine hydroxide

SS-11

Anhydro-5,5'-dichloro-9-ethyl-3,3'-bis(2-sulfoethylcarbamoylmethyl)thiacarbocyanine hydroxide, sodium salt

SS-12

Anhydro-5',6'-dimethoxy-9-ethyl-5-phenyl- 3-(3-sulfobutyl)-3'-(3-sulfopropyl)oxathiacarbocyanine hydroxide, sodium salt

SS-13

Anhydro-5,5'-dichloro-9-ethyl-3-( 3-phosphonopropyl)-3'-(3-sulfopropyl)thiacarbocyanine hydroxide

SS-14

Anhydro-3,3'-bis(2-carboxyethyl)-5,5'-dichloro-9-ethylthiacarbocyanine bromide

SS-15

Anhydro-5,5'-dichloro-3-(2-carboxyethyl)-3'-(3-sulfopropyl)thiacyanine sodium salt

SS-16

9-(5-Barbituric acid)-3,5-dimethyl-3'-ethyltellurathiacarbocyanine bromide

SS-17

Anhydro-5,6-methylenedioxy-9-ethyl-3-methyl- 3'-(3-sulfopropyl)tellurathiacarbocyanine hydroxide

SS-18

3-Ethyl-6,6'-dimethyl-3'-pentyl-9,11-neopentylenethiadicarbocyanine bromide

SS-19

Anhydro-3-ethyl-9,11-neopentylene-3'-(3-sulfopropyl)thiadicarbocyanine hydroxide

SS-20

Anhydro-3-ethyl-11,13-neopentylene-3'-( 3-sulfopropyl)-oxathiatricarbocyanine hydroxide, sodium salt

SS-21

Anhydro-5-chloro-9-ethyl-5'-phenyl-3'-( 3-sulfobutyl)-3-(3-sulfopropyl)oxacarbocyanine hydroxide, sodium salt

SS-22

Anhydro-5,5'-diphenyl-3,3'-bis(3-sulfobutyl)- 9-ethyloxacarbocyanine hydroxide, sodium salt

SS-23

Anhydro-5,5'-dichloro-3,3'-bis(3-sulfopropyl)-9-ethylthiacarbocyanine hydroxide, triethylammonium salt

SS-24

Anhydro-5,5'-dimethyl-3,3'-bis(3-sulfopropyl)-9-ethylthiacarbocyanine hydroxide, sodium salt

SS-25

Anhydro-5,6-dichioro-1-ethyl-3-(3-sulfobutyl)-1'-( 3-sulfopropyl)benzimidazolonaphtho[1,2-d]thiazolocarbocyanine hydroxide, triethylammonium salt

SS-26

Anhydro-1,1'-bis(3-sulfopropyl)-11-ethylnaphth[1,2-d]-oxazolocarbocyanine hydroxide, sodium salt

SS-27

Anhydro-3,9-diethyl-3'-methylsulfonylcarbamoylmethyl-5-phenyloxathiacarbocyanine p-toluenesulfonate

SS-28

Anhydro-6,6 ' -dichloro-1,1'-diethyl-3,3 ' -bis ( 3-sulfopropyl)-5,5'-bis(trifluoromethyl)benzimidazolocarbocyanine hydroxide, sodium salt

SS-29

Anhydro-5'-chloro-5-phenyl-3,3'-bis( 3-sulfopropyl )oxathiacyanine hydroxide, triethylammonium salt

SS-30

Anhydro-5,5'-dichloro-9-ethyl-3,3'-bis( 3-sulfopropyl)-thiacarbocyanine hydroxide, sodium salt

SS-31

3-Ethyl-5-[1,4-dihydro-1-(4-sulfobutyl)pyridin- 4-ylidene] rhodanine, triethylammonium salt

SS-32

1-Carboxyethyl-5-[2-(3-ethylbenzoxazolin- 2-ylidene)-ethylidene]-3-phenylthiohydantoin

SS-33

4-[2-(1,4-Dihydro-1-dodecylpyridinylidene)ethylidene]-3-phenyl-2-isoxazolin-5-one

SS-34

5-(3-Ethylbenzoxazolin-2-ylidene)-3-phenylrhodanine

SS-35

1,3-Diethyl-5-{[1-ethyl-3-(3-sulfopropyl)benzimidazolin-2-ylidene]ethylidene}-2-thiobarbituric acid

SS-36

5-[2-(3-Ethylbenzoxazolin-2-ylidene)ethylidene]- 1-methyl-2-dimethylamino-4-oxo-3-phenylimidazolinium p-toluenesulfonate

SS-37

5-[2-(5-Carboxy-3-methylbenzoxazolin- 2-ylidene)ethyl-idene]-3-cyano-4-phenyl-1-( 4-methylsulfonamido-3-pyrrolin-5-one

SS-38

2-[4-(Hexylsulfonamido)benzoylcyanomethine]-2-{ 2-{3-(2-methoxyethyl)-5-[(2-methoxyethyl)sulfonamido] bezoxazolin-2-ylidene}ethylidene}acetonitrile

SS-39

3-Methyl-4-[2-(3-ethyl-5,6-dimethylbenzotellurazolin-2-ylidene)ethylidene]-1-phenyl-2-pyrazolin-5-one

SS-40

3-Heptyl-1-phenyl-5-{4-[3-( 3-sulfobutyl)-naphtho [1,2-d] thiazolin]- 2-butenylidene}-2-thiohydantoin

SS-41

1,4-Phenylene-bis(2-aminovinyl-3-methyl-2-thiazolinium) dichloride

SS-42

Anhydro-4-{2-[3-(3-sulfopropyl) hiazolin- 2-ylidene]-ethylidene}-2-{3-[3-( 3-sulfopropyl)thiazolin-2-ylidene]propenyl- 5-oxazolium, hydroxide, sodium salt

SS-43

3-Carboxymethyl-5-{3-carboxymethyl-4-oxo- 5-methyl-1,3,4-thiadiazolin-2-ylidene)ethylidene]thiazolin-2-ylidene}rhodanine, dipotassium salt

SS-44

1,3-Diethyl-5-[1-methyl-2- ( 3,5-dimethylbenzotellurazolin-2-ylidene)ethylidene]- 2-thiobarbituric acid

SS-45

3-Methyl-4-[2-(3-ethyl- 5,6-dimethylbenzotellurazolin-2-ylidene)- 1-methylethylidene]-1-phenyl-2-pyrazolin-5-one

SS-46

1,3-Diethyl-5-[1-ethyl-2-(3-ethyl- 5,6-dimethoxybenzotetellurazolin-2-ylidene)ethylidene]- 2-thiobarbituric acid

SS-47

3-Ethyl-5-{[(ethylbenzothiazolin-2-ylidene)-methyl)]-[(1,5-dimethylnaphtho[1,2-d]selenazolin-2-ylidene)-methyl] methylene}rhodanine

SS-48

5-{Bis[(3-ethyl-5,6-dimethylbenzothiazolin- 2-ylidene)-methyl]methylene}-1,3-diethylbarbituric acid

SS-49

3-Ethyl-5-{[(3-ethyl-5-methylbenzotellurazolin- 2-ylidene)methyl][1-ethylnaphtho [1,2-d]-tellurazolin- 2-ylidene)methyl]methylene}rhodanine

SS-50

Anhydro-5,5'-diphenyl-3,3'-bis (3-sulfopropyl)thiacyanine hydroxide, triethylammonium salt

SS-51

Anhydro-5-chloro-5'-phenyl-3,3'-bis( 3-sulfopropyl)thiacyanine hydroxide, triethylammonium salt

SS-52

Anhydro-5-chloro-5'-pyrrolo-3,3'-bis( 3-sulfopropyl)-thiacyanine hydroxide, triethylammonium salt

SS-53

1,1'-Diethyl-2,2'-cyanine p-toluenesulfonate

Once an emulsion has been prepared with peptized clumps of agglomerated grains, the remaining procedures for photographic element construction, exposure and processing can take any convenient conyentional form. These features are summarized in Research Disclosure, Item 36544, cited above, which includes the following topics:

I. Emulsion grains and their preparation

II. Vehicles, vehicle extenders, vehicle-like addenda and vehicle related addenda III. Emulsion washing IV. Chemical sensitization V. Spectral sensitization and desensitization VI. UV dyes/optical brighteners/luminescent dyes VII. Antifoggants and stabilizers VIII. Absorbing and scattering materials IX. Coating physical property modifying addenda X. Dye image formers and modifiers XI. Layers and layer arrangements XII. Features applicable to color negative XIII. Features applicable only to color positive XIV. Scan facilitating features XV. Supports XVI. Exposure XVII. Physical development systems XIX. Development XX. Desilvering, washing, rinsing and stabilizing Examples The invention can be better appreciated by reference to the following specific examples.

Example 1

This example compares an emulsion according to the invention with a convention dispersed grain emulsion of the same mean grain size in a black-and-white (silver imaging) application.

Emulsion A (comparative)

A fine grain AgBr emulsion containing spectral sensitizing dye SS-21 was prepared as follows:

An 11.3 L solution containing $1\times10^{-3}$M NaBr was provided in a stirred reaction vessel at 50° C. Prior to the start of precipitation, 9 g of a 1 percent by weight solution of 4,7,13,16-tetraoxa-1,10-dithiacyclooctadecane in methanol was added to the reactor. Thirty seconds after the addition of this material, a 2.0M solution of $AgNO_3$ was added to the reactor at 220 mL/min with vigorous stirring. A 2.0M solution of NaBr was added simultaneously at 225 mL/min, and this precipitation lasted for 1.0 minute.

Directly following the precipitation, 11 g of a 3.4 percent by weight solution of SS-21 in methanol was added to the reactor and held for 0.2 minute. A 900 mL solution containing 6 percent by weight gelatin and 1 mL of a polyglycol diester based antifoamant were then added to the reactor, followed by a 1 minute hold. At this point an emulsion had been prepared with individually dispersed grains, each spectrally sensitized and prevented from clumping by the presence of peptizer.

To keep the preparation of this emulsion as analogous as possible to the preparation of Emulsion B, described below, a solution of 540 mL of 5M $NaNO_3$ was then added to the reactor, followed by a 10 minute hold with vigorous stirring. Since the grains had already been peptized, no grain agglomeration occurred as a result of adding the $NaNO_3$.

Figure 3:
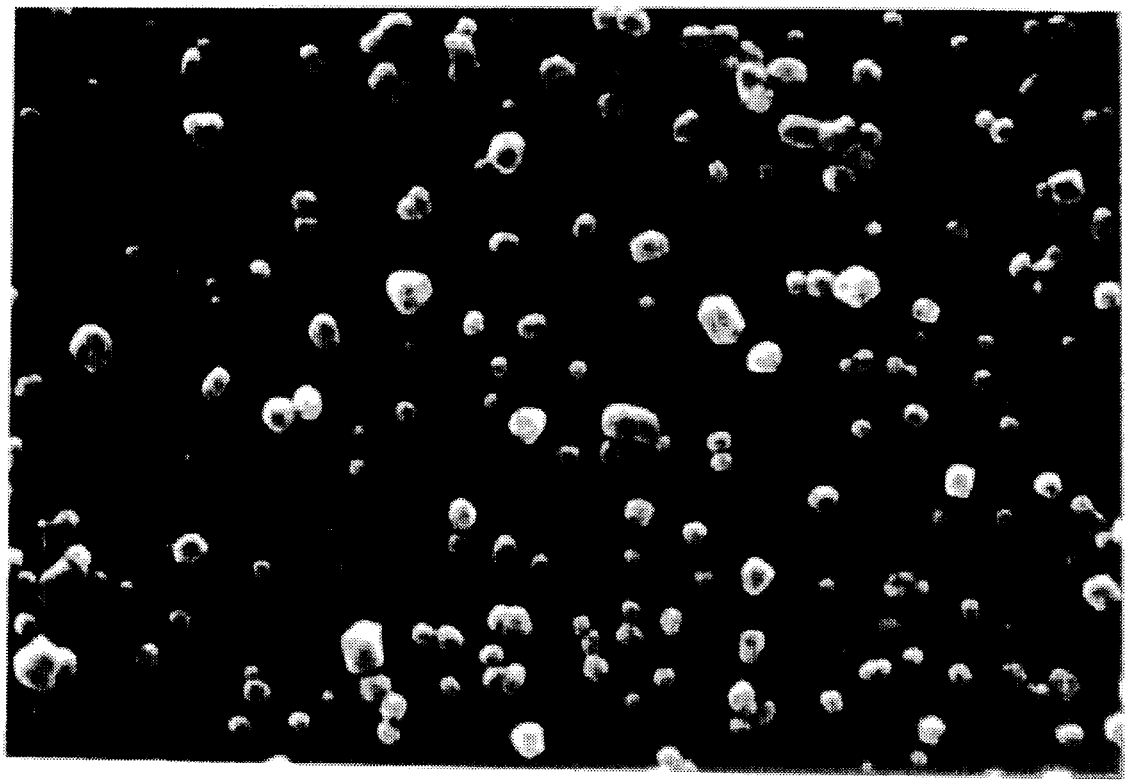
FIG. 3 (PRIOR ART)
FIG. 3 demonstrates a conventional emulsion with individually dispersed grains.

The resulting emulsion was desalted and adjusted to a pBr of 4. The resulting emulsion contained fine grains, individually dispersed with a mean ECD of 0.06 μm. A scanning electron micrograph of the resulting emulsion is shown in FIG. 3.

Emulsion B (example)

This emulsion was prepared identically to Emulsion A through the addition of SS-21. After the dye was added, the emulsion was held for 0.5 minute, followed by the addition of 540 mL of 5M $NaNO_3$. After a 0.5 minute hold, a 900 mL solution containing 6 percent by weight gelatin and 1 mL of a polyglycol based diester antifoamant was added to the reactor, followed by a 10 minute hold with vigorous stirring. Thus, the emulsion preparation was essentially similar to the preparation of Emulsion A, except that the $NaNO_3$ salt addition occurred before rather than after peptizer addition.

Figure 2:
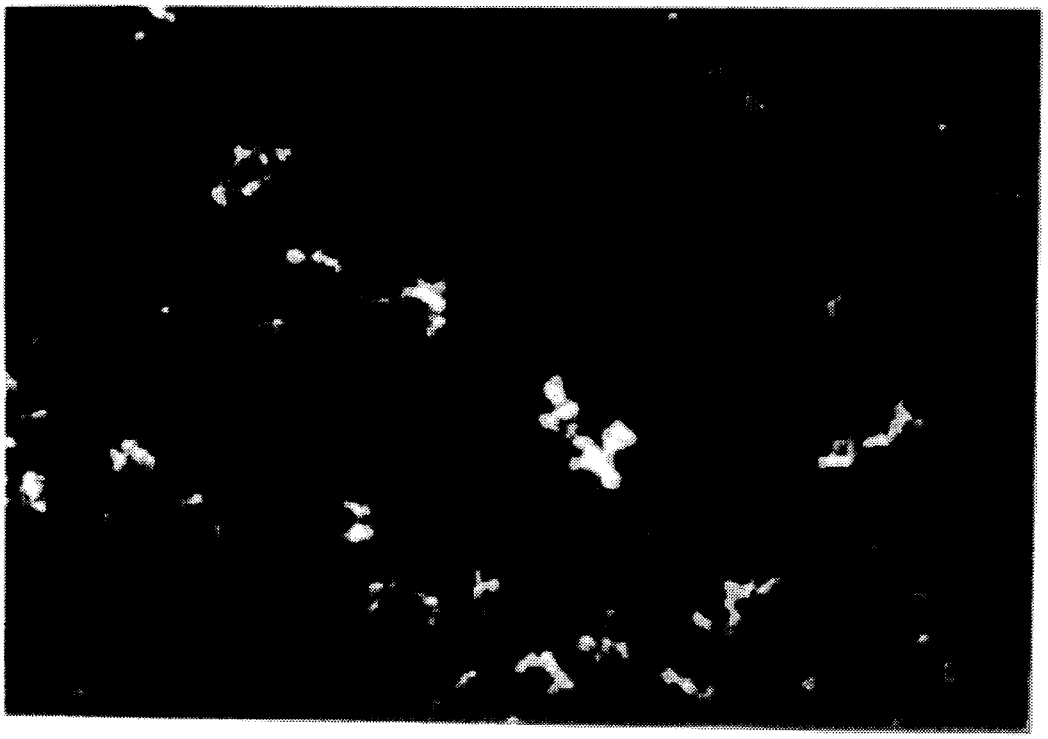
FIG. 2 is a view of the same emulsion as in FIG. 1, but with the level of magnification reduced to allow the overall pattern of discrete clumps to be observed.

The resulting emulsion was desalted and adjusted to a pBr of 4. The emulsion contained fine grains that were agglomerated into clumps. A scanning electron photomicrograph of a single grain clump is shown in FIG. 1. In FIG. 2 a lower level of enlargement was employed to allow the distribution of grain clumps to be observed.

Photographic Coatings

Each emulsion was coated on an antihalation support at 2.15 g/m$^2$ of silver and 3.23 g/m$^2$ gel. This emulsion layer was overcoated with 3.23 g/m$^2$ gelatin. The emulsion and overcoat were hardened using bis(vinylsulfonylmethyl)ether at 1.8 percent by weight, based on total gelatin.

Sensitometry

The photographic coatings were evaluated for sensitivity to minus blue light by exposing for 1 second with a step wedge sensitometer using a 3000° K. tungsten lamp filtered to simulate a Daylight V light source and further filtered to transmit only green and red light by using a Kodak Wratten™ 9 filter (transmittance <0.1% at wavelengths shorter than 460 nm).

The exposed coatings were identically photographically processed using Developer I, a hydroquinone-Elon™ (p-N-methylaminophenol hemisulfate) developer.

Developer I

| Component | Wt. % |
|---|---|
| p-N-Methylaminophenol hemisulfate | 0.5 |
| Hydroquinone | 1.0 |
| Sodium sulfite | 7.2 |
| Sodium metaborate | 3.5 |
| Sodium bromide | 0.5 |
| Sodium hydroxide | 0.35 |
| Potassium Iodide | $1\times10^{-6}$ |
| Water to 1 Liter | |

Granularities were obtained by employing a microdensitometer having a 48 μm aperture. Reported rms granularities were observed at a density of 0.8 above fog. Photographic speed was measured at a density of 0.15 above fog. Speed is reported in relative log units (30 units=0.30 log E, where E is exposure in lux-seconds).

The sensitometric results are summarized in Table I below:

TABLE I

| Emulsion | Relative Log Speed | rms Granularity |
|---|---|---|
| A (comparative) | 100 | 0.0068 |
| B (example) | 227 | 0.02 |

Although the grainsof Emulsions A and B were of the same mean size, Emulsion B, in which the grains were clumped, exhibited a speed that was 1.27 log E faster than that of Emulsion A. This was a remarkable speed increase. Emulsion B was approximately 20 times faster than Emulsion A. The granularity of Emulsion B was significantly higher than that of Emulsion A, but the granularity of Emulsion B was no higher than would be expected for a conventional emulsion of its sensitivity. That is, it is generally recognized that each stop (30 relative speed units) increase in speed can be expected to impart a granularity increase of 7 grain units. The granularity of Emulsion B was 22 grain units higher than the granularity Emulsion A, which is about what would be expected, based on the speed difference.

Example 2

This example compares an emulsion according to the invention with a conventional dispersed grain emulsion of the same mean grain size in a color (dye imaging) application.

Example 1 was repeated, except that coating and development were modified to produce dye images. The coatings were modified by decreasing the coating coverage of silver to 0.75 g/m$^2$ while adding to the emulsion 1.08 g/m$^2$ of cyan dye-forming coupler, C-1.

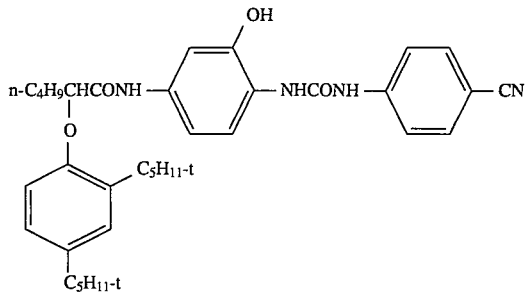

Cyan Dye-Forming Coupler C-1

Exposure was as described in Example 1, except that the exposure time was extended to 5 seconds.

Development was undertaken for 3 minutes, 15 seconds in a color developer, Developer II.

Developer II

| Component | Wt. % |
|---|---|
| Potassium carbonate, anhydrous | 3.43 |
| Potassium bicarbonate | 0.232 |
| Sodium sulfite, anhydrous | 0.038 |
| Sodium metabisulfite | 0.278 |
| Potassium iodide | $1.2 \times 10^{-6}$ |
| Sodium bromide | 0.131 |
| Diethylenetriaminepentaacetic acid, pentasodium salt (40% solution) | 0.843 |
| Hydroxylamine sulfate | 0.241 |
| 2-[2-(4-amino-3-methylphenyl)ethylamino]ethanol sulfate | 0.452 |

Setting the relative log speed of the Emulsion A coating at 100, the relative log speed of Emulsion B was 221.

Example 3

This example repeated Example 2, except that spectral sensitizing dye SS-30 was substituted for spectral sensitizing dye SS-21. A qualitatively similar result was obtained, although the speed advantage for the emulsion satisfying the requirements of the invention relative to the comparison emulsion was smaller.

Example 4

This example demonstrates the capability of a spectral sensitizing dye to produce grain agglomeration.

A 0.5 L solution of 0.001 molar sodium bromide was provided in a stirred reaction vessel at 50° C. Prior to the start of precipitation, 1.5 mL of a 1% solution of 4,7,13,16-tetraoxa-1,10-dithiacyclooctadecane in methanol was added. A 2.0M solution of $AgNO_3$ was added to the reaction vessel at 30 cc/min with vigorous stirring. A 2.0M solution of NaBr was added simultaneously at a rate of 30 mL/min. The duration of precipitation was 20 seconds. The resulting precipitate was held for 30 seconds, followed by the addition of $1.06\times10^{-4}$ mole of SS-53 in a methanol solution. The resultant mixture was held for 30 seconds, followed by the addition of 40 g of a 6% gel solution that also contained 1 mL of a polyglycol diester based antifoamant. This material was then stirred vigorously for 1 minute.

Examination of the emulsion revealed agglomerated grains, similar in appearance to those of Emulsion B, described above.

Example 5

This example has as its purpose to demonstrate the applicability of the invention to high chloride emulsions.

Example 2 was .repeated, except that the following emulsions were substituted for Emulsions A and B:

Emulsion C (comparative)

An 11.3 L solution of 0.00277M NaCl was provided in a stirred reaction vessel at 40° C. A 2.0M solution of $AgNO_3$ was added to the reactor at 220 cc/min with vigorous stirring. A 2.0M solution of NaCl was added simultaneously in order to maintain a pCl of 2.56. The precipitation lasted 35 seconds. Directly following the precipitation, 11 g of a 3.4% solution of SS-21 in methanol was added to the reactor and held for 0.2 min. A 900 mL solution containing 6% gelatin and 1 mL of a polygycol diester antifoamant was added to the reactor, followed by a 1 minute hold. A solution of 540 mL of 5M $NaNO_3$ was then added to the reactor, followed by a 10 minute hold with vigorous stirring. The resulting emulsion was desalted and maintained at a pCl of 2.25. The emulsion contained individually peptized silver chloride grains.

Emulsion D (example)

The emulsion was prepared similarly to Emulsion C up to and including the addition of spectral sensitizing dye SS-21. After SS-21 was added, the emulsion was held for 30 seconds, followed by the addition of 540 mL of 5M $NaNO_3$. After 30 seconds a 900 mL solution containing 6% gelatin and 1 mole of a polyglycol diester antifoamant was added to the reactor, followed by a 10 minute hold with vigorous stirring. The resulting emulsion was desalted and adjusted to a pCl of 2.25. The resulting emulsion contained agglomerated AgCl grains.

Sensitometric results were qualitatively similar result to those reported in Example 2, although the speed advantage for the emulsion satisfying the requirements of the invention relative to the comparison emulsion was smaller than in Example 2.

The invention has been described in detail with particular reference to preferred embodiments thereof, but it will be understood that variations and modifications can be effected within the spirit and scope of the invention.

What is claimed is:

1. A radiation sensitive emulsion comprised of a dispersing medium containing a peptizer and silver halide grains WHEREIN the silver halide grains (1) are each surface sensitized and (2) are agglomerated into discrete clumps with adjacent separate grains lying in direct contact, the discrete clumps being separated by the peptizer and having a mean equivalent circular diameter of less than 10 μm.

2. A radiation sensitive emulsion according to claim 1 wherein the grains are chemically sensitized.

3. A radiation sensitive emulsion according to claim 1 wherein the grains are spectrally sensitized.

4. A radiation sensitive emulsion according to claim 3 wherein the spectral sensitizing dye is a polymethine dye.

5. A radiation sensitive emulsion according to claim 1 wherein the mean equivalent circular diameter of the grain clumps is less than 5 μm.

6. A radiation sensitive emulsion according to claim 1 wherein the grains exhibit a mean grain volume of less than $1.5\times10^{-2}$ μm$^3$.

7. A radiation sensitive emulsion according to claim 6 wherein the grains exhibit a mean grain volume of less than $1.0\times10^{-2}$ $\mu m^3$.

8. A radiation sensitive emulsion according to claim 1 wherein the clumps contain an average of at least 5 grains per clump.

9. A process of preparing a radiation sensitive emulsion comprising (1) forming silver halide grains in the absence of a peptizer, (2) chemically sensitizing the grains, (3) agglomerating the grains so that adjacent grains lie in direct contact, and (4) adding a peptizer to form discrete clumps of the grains agglomerated in step (3).

10. A process according to claim 9 wherein the grains are chemically sensitized following step (4).

* * * * *